US010450742B2

(12) United States Patent
Evans et al.

(10) Patent No.: US 10,450,742 B2
(45) Date of Patent: Oct. 22, 2019

(54) UNBONDED LOOSEFILL INSULATION

(71) Applicant: Owens Corning Intellectual Capital, LLC, Toledo, OH (US)

(72) Inventors: Michael Evans, Granville, OH (US); James Justin Evans, Granville, OH (US); Patrick M. Gavin, Pleasant Prairie, WI (US); Steven Schmitt, Newark, OH (US); Tim Newell, Nephi, UT (US); William E. Downey, Granville, OH (US); Kenneth J. Wiechert, Newark, OH (US); Justin Depenhart, Mountain View, CA (US); David Michael Cook, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 285 days.

(21) Appl. No.: 15/403,379

(22) Filed: Jan. 11, 2017

(65) Prior Publication Data

US 2017/0198472 A1 Jul. 13, 2017

Related U.S. Application Data

(60) Provisional application No. 62/287,527, filed on Jan. 27, 2016, provisional application No. 62/277,348, filed on Jan. 11, 2016.

(51) Int. Cl.
*E04B 1/78* (2006.01)

(52) U.S. Cl.
CPC ..... *E04B 1/78* (2013.01)

(58) Field of Classification Search
CPC ..... E04B 1/78; E04B 1/7604
See application file for complete search history.

(56) References Cited

U.S. PATENT DOCUMENTS 4,340,090 A 7/1982 Matsushita et al.
4,370,365 A 1/1983 Takamizawa et al.
4,477,524 A 10/1984 Brown et al.
4,500,584 A 2/1985 Modic
4,868,063 A 9/1989 Okamura et al.
5,220,762 A 6/1993 Lehnert et al.
5,605,757 A 2/1997 Klett
5,624,742 A * 4/1997 Babbitt ..... C03B 37/04 156/62.2
5,665,471 A 9/1997 Kosal et al.
5,690,715 A 11/1997 Schiwek
5,698,479 A 12/1997 Ogata et al.
5,849,832 A 12/1998 Vimelson et al.
6,001,437 A 12/1999 Thorpe et al.
6,077,883 A 6/2000 Taylor et al.
6,313,335 B1 11/2001 Roberts et al.
6,562,257 B1 5/2003 Chen et al.
7,223,455 B2 5/2007 Ruid et al.
7,448,494 B2 11/2008 LaSalle
7,563,395 B2 7/2009 Iio et al.
7,608,159 B2 10/2009 Fellinger et al.
7,772,347 B2 8/2010 Swift et al.
7,780,816 B2 8/2010 Toas et al.
7,795,328 B2 9/2010 Angenendt
7,807,771 B2 10/2010 Swift et al.
7,838,448 B2 11/2010 Shooshtari et al.
7,888,445 B2 2/2011 Swift et al.
7,981,961 B2 7/2011 Heller et al.
8,034,415 B2 10/2011 Huenig et al.
8,129,018 B2 3/2012 Hartman et al.
8,186,436 B2 5/2012 Carlos
8,211,974 B2 7/2012 Shooshtari et al.
8,552,140 B2 10/2013 Swift
8,772,422 B2 7/2014 Saxena et al.
8,940,089 B2 1/2015 Hampson et al.
2006/0216489 A1 9/2006 Shooshtari et al.
2006/0217471 A1 9/2006 Shooshtari et al.
2006/0258248 A1 11/2006 Shooshtari et al.
2007/0036975 A1 2/2007 Miele et al.
2007/0082208 A1 4/2007 Shooshtari et al.
2007/0141362 A1 6/2007 Elkins et al.
2007/0264465 A1 11/2007 Klose
2008/0020206 A1 1/2008 Fay
2008/0038977 A1 2/2008 Lebduska et al.
2008/0149212 A1 6/2008 Relats et al.
2008/0292739 A1 11/2008 Kashikar et al.
2009/0054580 A1 2/2009 Joachim et al.
2009/0298367 A1 12/2009 Lafaysse et al.
2009/0324915 A1 12/2009 Swift et al.
2010/0040832 A1 2/2010 Herbert
2010/0197185 A1 8/2010 Herbert
2011/0003522 A1 1/2011 Chen et al.
2012/0168054 A1 7/2012 Chen et al.
2012/0205571 A1 8/2012 Lewis
2013/0040108 A1 2/2013 Asrar et al.
2013/0045352 A1 2/2013 Kern et al.
2013/0334726 A1 12/2013 Hernandez-Torres et al.
2014/0027662 A1 1/2014 Shooshtari et al.
2014/0186635 A1 7/2014 Mueller
2015/0284638 A1 10/2015 Xu et al.
2015/0352758 A1 12/2015 Kim et al.

* cited by examiner

*Primary Examiner* — C Melissa Koslow
(74) *Attorney, Agent, or Firm* — Calfee, Halter & Griswold LLP

(57) ABSTRACT

A loosefill insulation installation includes a loosefill insulation material made from fiberglass fibers. The loosefill insulation material unexpectedly has improved thermal performance, even through the amount of mineral oil applied to the fiberglass fibers is reduce. For example, the fiberglass fibers can be coated with a mineral oil in an amount that is between 0.1% and 0.6% of the weight of the fiberglass fibers, such as about 0.375%.

8 Claims, 6 Drawing Sheets

600

UNBONDED LOOSEFILL INSULATION

RELATED APPLICATIONS

The present application claims the benefit of U.S. provisional patent application No. 62/277,348, filed on Jan. 11, 2016, titled "Unbonded Loosefill Insulation" and U.S. provisional patent application No. 62/277,527, filed on Jan. 27, 2016, "Unbonded Loosefill Insulation." U.S. provisional patent application Nos. 62/277,348 and 62/277,527 are incorporated herein by reference in their entireties.

BACKGROUND

In the insulation of buildings, a frequently used insulation product is unbonded loosefill insulation material. In contrast to the unitary or monolithic structure of insulation batts or blankets, unbonded loosefill insulation material is a multiplicity of discrete, individual tufts, cubes, flakes or nodules. Unbonded loosefill insulation material can be applied to buildings by blowing the loosefill insulation material into insulation cavities, such as sidewall cavities, floor cavities, ceiling cavities, or an attic of a building. Typically unbonded loosefill insulation is made of glass fibers although other mineral fibers, organic fibers, and cellulose fibers can be used.

Unbonded loosefill insulation material is typically compressed and packaged in a bag. The bags of compressed unbonded loosefill insulation are transported from an insulation manufacturing site to a building that is to be insulated. The compressed unbonded loosefill insulation can be packaged with a compression ratio of at least about 10:1. The distribution of unbonded loosefill insulation into an insulation cavity typically uses a loosefill blowing machine that feeds the unbonded loosefill insulation pneumatically through a distribution hose. Loosefill blowing machines can have a chute or hopper for containing and feeding the compressed unbonded loosefill insulation after the package is opened and the compressed unbonded loosefill insulation is allowed to expand.

SUMMARY

The present application is directed to loosefill insulation. In one exemplary embodiment, A loosefill insulation installation includes a loosefill insulation material made from fiberglass fibers. The loosefill insulation material unexpectedly has improved thermal performance, even through the amount of mineral oil applied to the fiberglass fibers is reduce. For example, the fiberglass fibers can be coated with a mineral oil in an amount that is between 0.1% and 0.6% of the weight of the fiberglass fibers, such as about 0.375%.

In one exemplary embodiment, a loosefill insulation installation comprises a loosefill insulation material made from fiberglass fibers; wherein the loosefill insulation material has an average installed thickness of 10.5 inches; wherein the average thermal resistance (R) of the 10.5 inches of installed loosefill insulation material is greater than or equal to 30; wherein the average density of the 10.5 inches of installed loosefill insulation material is less than or equal to 0.485 pounds per cubic foot wherein the fiberglass fibers are coated with a mineral oil in an amount that is between 0.1% and 0.6% of the weight of the fiberglass fibers.

In one exemplary embodiment, the average density of the 10.5 inches of installed loosefill insulation material is less than or equal to 0.472 pounds per cubic foot.

In one exemplary embodiment, the fiber glass fibers comprise a combination of two or more of $SiO_2$, $Al_2O_3$, CaO, MgO, $B_2O_3$, $Na_2O$, $K_2O$, and $Fe_2O_3$.

In one exemplary embodiment, the mineral oil is between 0.3% and 0.5% of the weight of the fiberglass fibers.

In one exemplary embodiment, the mineral oil is a blend of light and heavy paraffinic oils.

In one exemplary embodiment, the mineral oil has a viscosity of less than or equal to 20 cST at 40 degrees centigrade, and less than or equal to 50 cST at 20 degrees centigrade.

In one exemplary embodiment, the mineral oil has a pour point that is in the range of −10 degrees Fahrenheit to 0 degrees Fahrenheit.

In one exemplary embodiment, the mineral oil has a flash point that is below or equal to 365 degrees Fahrenheit.

In one exemplary embodiment, a ratio of the thermal conductivity of the loosefill insulation installation to an ideal batt having the same density as the average density of the loosefill insulation installation is between one and 1.5.

In one exemplary embodiment, a loosefill insulation material made from fiberglass fibers is disclosed. The loosefill insulation material has an average installed thickness. The average density of the 10.5 inches of installed loosefill insulation material is less than or equal to 0.485 pounds per cubic foot. A ratio of the thermal conductivity of the loosefill insulation installation to an ideal batt having the same density as the average density of the loosefill insulation installation is between one and 1.5. The fiberglass fibers are coated with a mineral oil in an amount that is between 0.1% and 0.6% of the weight of the fiberglass fibers.

In one exemplary embodiment, the fiber glass fibers comprise a combination of two or more of $SiO_2$, $Al_2O_3$, CaO, MgO, $B_2O_3$, $Na_2O$, $K_2O$, and $Fe_2O_3$.

In one exemplary embodiment, the mineral oil is between 0.3% and 0.5% of the weight of the fiberglass fibers.

In one exemplary embodiment, the mineral oil is a blend of light and heavy paraffinic oils.

In one exemplary embodiment, the mineral oil has a viscosity of less than or equal to 20 cST at 40 degrees centigrade, and less than or equal to 50 cST at 20 degrees centigrade.

In one exemplary embodiment, the mineral oil has a pour point in the range of −10 degrees Fahrenheit to 0 degrees Fahrenheit.

In one exemplary embodiment, the mineral oil has a flash point that is below or equal to 365 degrees Fahrenheit.

In one exemplary embodiment, a ratio of the thermal conductivity of the loosefill insulation installation to an ideal batt having the same density and thickness as the loosefill insulation installation is between one and 1.4.

DETAILED DESCRIPTION

Figure 1:
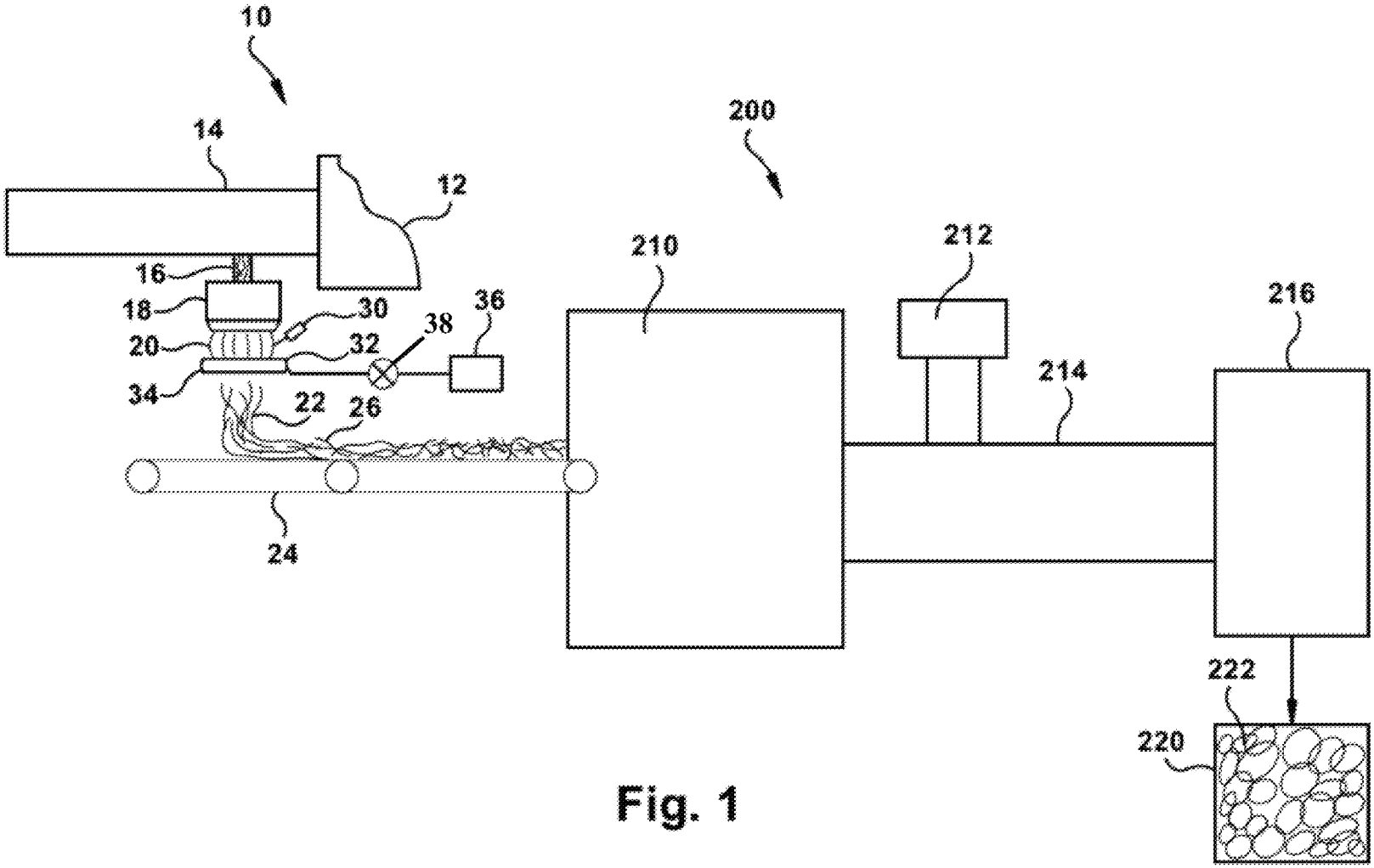
FIG. 1 is a schematic illustration of an apparatus for making and packaging unbonded loosefill insulation.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Numerical ranges set forth in the specification are meant to disclose not only the range stated, but also all subranges and numerical values within the stated numerical range. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose an improved unbonded loosefill insulation installation (herein "loosefill installation"). A loosefill installation comprises loosefill insulation material (hereafter "loosefill material") formed from mineral fibers that is provided in an attic or in a wall at an average thickness T and at an average density. Generally, the mineral fibers are formed and processed in a manner that enhances the thermal conductivity or R value of a loosefill installation having the average thickness T and the average density. The terms "unbonded loosefill insulation material" or "loosefill material", as used herein, is defined to mean any conditioned insulation material configured for distribution in an airstream. The term "unbonded", as used herein, is defined to mean the absence of a binder. The term "conditioned", as used herein, is defined to mean the separating and/or shredding of the loosefill material to a desired density prior to distribution in an airstream. The term "R value", as used herein, is defined to mean a measure of thermal resistance and is usually expressed as $ft^2 \cdot {}^\circ F. \cdot h/Btu$.

Referring now to FIG. 1, one non-limiting example of a process for manufacturing mineral fibers for use as loosefill material is shown generally at 10. A portion of FIG. 1 is a portion of FIG. 1 of published US Patent Application Pub. No. 2014/0339457, which is incorporated herein by reference in its entirety. For purposes of clarity, the manufacturing process 10 will be described in terms of glass fiber manufacturing, but the manufacturing process 10 is applicable as well to the manufacture of fibrous products of other mineral materials, such as the non-limiting examples of rock, slag and basalt.

Referring again to FIG. 1, molten glass 16 is supplied from a forehearth 14 of a furnace 12 to rotary fiberizers 18. The molten glass 16 can be formed from various raw materials combined in such proportions as to give the desired chemical composition. This proportion is termed the glass batch. The composition of the glass batch and the glass manufactured from it are commonly expressed in terms of percentages of the components expressed as oxides; typically $SiO_2$, $Al_2O_3$, CaO, MgO, $B_2O_3$, $Na_2O$, $K_2O$, $Fe_2O_3$ and minor amounts of other oxides. The glass composition controls various properties of the glass batch and the manufactured glass fibers including the non-limiting examples of viscosity, liquidus temperature, durability, thermal conductivity and biosolubility.

The fiberizers 18 receive the molten glass 16 and subsequently form veils 20 of glass fibers 22 and hot gases. The flow of hot gases can be created by optional blowing mechanisms, such as the non-limiting examples of an annular blower (not shown) or an annular burner (not shown), configured to direct the glass fibers 22 in a given direction, usually in a downward manner.

The veils 20 are gathered and transported to downstream processing stations. While the embodiment illustrated in FIG. 1 shows a quantity of one fiberizer 18, it should be appreciated that any desired number of fiberizers 18 can be used. In one embodiment, the glass fibers 22 are gathered on a conveyor 24 such as to form a blanket or batt 26.

Referring again to FIG. 1, spraying mechanisms 30 can be configured to spray fine droplets of water onto the hot gases in the veils 20 to help cool the flow of hot gases. The spraying mechanisms 30 can be any desired structure, mechanism or device sufficient to spray fine droplets of water onto the hot gases in the veils 20 to help cool the flow of hot gases.

In the manufacture of fibrous blankets or batts 26, it is known to design the glass composition to optimize the infrared radiation absorption and thus decrease the thermal conductivity (k) of the resulting glass product. The thermal conductivity (k) of the resulting blankets or batts 26 is a measure of the amount of heat, in BTUs used per hour, which will be transmitted through one square foot of material that is one inch thick to cause a temperature change of one degree Fahrenheit from one side of the material to the other side of the material. The SI unit for thermal conductivity (k) is watts/meter/Kelvin. The lower the thermal conductivity (k) for a material, the better it insulates. The thermal conductivity (k) for a fibrous material is dependent upon a number of variables including density of the fibers, fiber diameter, uniformity of the fiber distribution and composition of the glass. Increased pack density and reduced fiber diameter generally lead to lower thermal conductivities (k). One example of a disclosure for the composition of a glass batch for batts is U.S. Pat. No. 5,932,499 (issued Aug. 3, 1999 to Xu et al.), which incorporated herein by reference in its entirety. ASTM Standard C 518 can be used as a test method for steady-state thermal transmission properties with a heat flow meter apparatus and is incorporated herein by reference in its entirety. ASTM Standard C 687 can be used as a test method for determining thermal resistance of loose-fill building insulation and is incorporated herein by reference in its entirety. ASTM Standard C 764 can be used to specify mineral fiber loose-fill thermal insulation and is incorporated herein by reference in its entirety. ASTM Standard C 1374 can be used as a test method for determining the installed thickness of pneumatically applied loose-fill building insulation and is incorporated herein by reference in its entirety. ASTM Standard C 1574 is a guide for determining blown density of pneumatically applied loose-fill mineral fiber thermal insulation and is incorporated herein by reference in its entirety.

As used herein, the term "chemistry" refers to one or more chemicals that are applied to a surface of the glass fibers. For example, an emulsified silicone; may be applied to the glass fibers, after the glass fibers are formed and before the glass fibers are gathered on the conveyor 24. This chemistry may be applied with the cooling water, or downstream of the cooling water. In the illustrated embodiment, a series of nozzles 32 are positioned in a ring 34 around the veil 20 at a position below the fiberizers 18. The nozzles 32 are configured to supply the emulsified silicone to the glass fibers 22 from a source 36. The emulsified silicone is configured to prevent damage to the glass fibers 22 as the glass fibers 22 move through the manufacturing process 10 and come into contact with various apparatus components as well as other glass fibers 22, as well as, preventing damage to the glass fibers when the loosefill insulation material is installed to form the loosefill insulation installation. The application of the chemistry is controlled by a valve 38 such that the amount of chemistry, such as emulsified silicone, being applied can be precisely controlled. The chemistry can be a silicone compound. However, the chemistry can also be other materials, combinations of materials, or combinations of other materials with silicone.

The batt 26 is transported by the conveyor 24 to a loosefill forming device 200, such as a mill 210, transport fan 212, and ductwork 214. The mill 210 can take a wide variety of different forms. The mill 210 may include rotary hammers, cutting screens, shape cutters, such as cube cutters and the like. The mill 210 disassembles the blanket 26 into tufts of loosefill material. Operation of the mill 210 can be adjusted to perform product morphology and density adjustments (large vs. small 'nodules' of loosefill). In one exemplary embodiment, the disassembled blanket is pulled out of the mill 210 via the transport fan 212 through long duct work 214, which terminates at the baggers 216. The transport fan 212 dictates the dwell time of the fiberglass in the mill 210, and can be adjusted to adjust the density of the loosefill insulation material.

As discussed above, the tufts of glass fibers 22 and hot gases can be collected by the ductwork 212. The ductwork is shaped and sized to receive the tufts of glass fibers 22 and hot gases. The ductwork 212 is configured to transfer the glass fibers 22 and/or hot gases to or more processing stations for further handling. The ductwork 212 can be any generally hollow pipe members that are suitable for receiving and conveying the tufts of glass fibers 22 and hot gases.

Optionally, the glass fibers 22 can be coated with additional chemistry downstream of the mill 210. For example, the glass fibers 22 can be coated with additional chemistry in the ductwork 214, between mill 210 and the ductwork 214, and/or between the ductwork 214 and the bagger 216. Examples of chemistry that can be applied downstream of the mill includes, but is not limited to, reactive silicone, anti-static treatment, pigment, and mineral oil. Optional reactive silicone prevents the packaged unbonded loosefill material from sticking to itself when exposed to moisture and turning into a "brick-like" structure in the packaging bag 220. Optional anti-static treatment controls the 'static cling' that blown-in unbonded loosefill insulation may have to the surroundings when the unbonded loosefill insulation material is installed. Optional pigment gives the unbonded loosefill material a color, such as pink. Optional mineral oil is applied to keep the dust (small, stray glass strands) levels down during installation.

As applied, the mineral oil can take a wide variety of different forms. In one exemplary embodiment, the mineral oil is a blend of light and heavy paraffinic oils. The oil may be colorless and have very low odor. In one exemplary embodiment, the mineral oil has low viscosity, such as less than or equal to 25 cSt (centistrokes) at 40 C, and less than or equal to 55 cSt at 20 degrees C., such as less than or equal to 20 cSt at 40 degrees C., and less than or equal to 50 cSt at 20 degrees C., such as about 20 cSt at 40 degrees C., and about 50 cSt at 20 degrees C. In one exemplary embodiment, a pour point of the mineral oil in the range of 10 degrees Fahrenheit to 0 degrees Fahrenheit. In one exemplary embodiment, a flash point of the mineral oil is greater than or equal to 365 degrees Fahrenheit.

Referring again to FIG. 1 it should be noted that the manufacturing process 10 is being used to form loosefill material, a binder material is not applied to the glass fibers 22. However, it should be appreciated that insignificant amounts of binder could be applied to the fibers 22 as desired depending on the specific application and design requirements of the resulting loosefill material. In another exemplary embodiment, a binder can be applied to the glass fibers. The application of the binder to the glass fibers results in the shape of tufts or pieces of the loosefill insulation material to be better defined. A wide variety of different materials can be used. Any known binder used to make loosefill insulation tufts or insulation batts can be used.

In one exemplary embodiment, the ductwork 212 transfers the tufts 220 of fiberglass fibers 22 to downstream baggers 216 that compress the tufts 220 of glass fibers 22 into bags or packages of compressed loosefill material. The bags or packages of compressed loosefill material are ready for transport from an insulation manufacturing site to a building that is to be insulated. The bags can be made of polypropylene or other suitable material. During the packaging of the loosefill material, it is placed under compression for storage and transportation efficiencies. Typically, the loosefill material is packaged with a compression ratio of at least about 10:1.

The distribution of the loosefill material 222 to form an insulation installation typically uses an insulation blowing machine 310 that conditions the loosefill material and feeds the conditioned loosefill material pneumatically through a distribution hose 346. In an exemplary embodiment, a package 220 (see FIG. 1) of compressed unbonded loose fill material 222 is opened and fed into a hopper 314 of a blowing machine 310. In an exemplary embodiment, the blowing machine 310 has a set of paddles to open up the compressed material 222 and a fan blows the loosefill material through a long hose 346 to the point of installation. Blowing machine settings can be adjusted to adjust the properties of the loosefill insulation installation. Two of these adjustments are air to wool ratio and hose diameter.

The air to wool ratio is the ratio of the flow rate of the air provided by the blowing machine to the flow rate or amount of loosefill insulation provided by the blowing machine. A higher air to wool ratio (i.e. more air) results in a higher installation rate and is preferred by the contractor.

In one exemplary embodiment, the diameter of the hose 346 is between 3½ inches and 4 inches. In one exemplary embodiment, sections of hose having a diameter of 4 inches are connected to the blowing machine and the loosefill insulation material 222 is dispensed from the end of the 4 inch diameter section to the site of the insulation installation.

In one exemplary embodiment, sections of hose having a diameter of 3½ inches are connected to the blowing machine and the loosefill insulation material 222 is dispensed from the end of the 3½ inch diameter section to the site of the insulation installation. In one exemplary embodiment, one or more sections of hose having a diameter of 4 inches is connected to the blowing machine, one or more sections of hose having a diameter of 3½ inches is connected to the 4 inch diameter section, and the loosefill insulation material 222 is dispensed from the end of a 3½ inch diameter section to the site of the insulation installation. For a given air flow and mass flow rate of loosefill insulation, the larger hose diameters of 3½-4 inches in diameter decreases the density of the fiberglass insulation installation as compared to a hose with a smaller diameter, such as a hose having a 2½ inch 3 inch diameter. The larger hose diameters of 3½-4 inches also allow for faster material feed rates.

Figure 2:
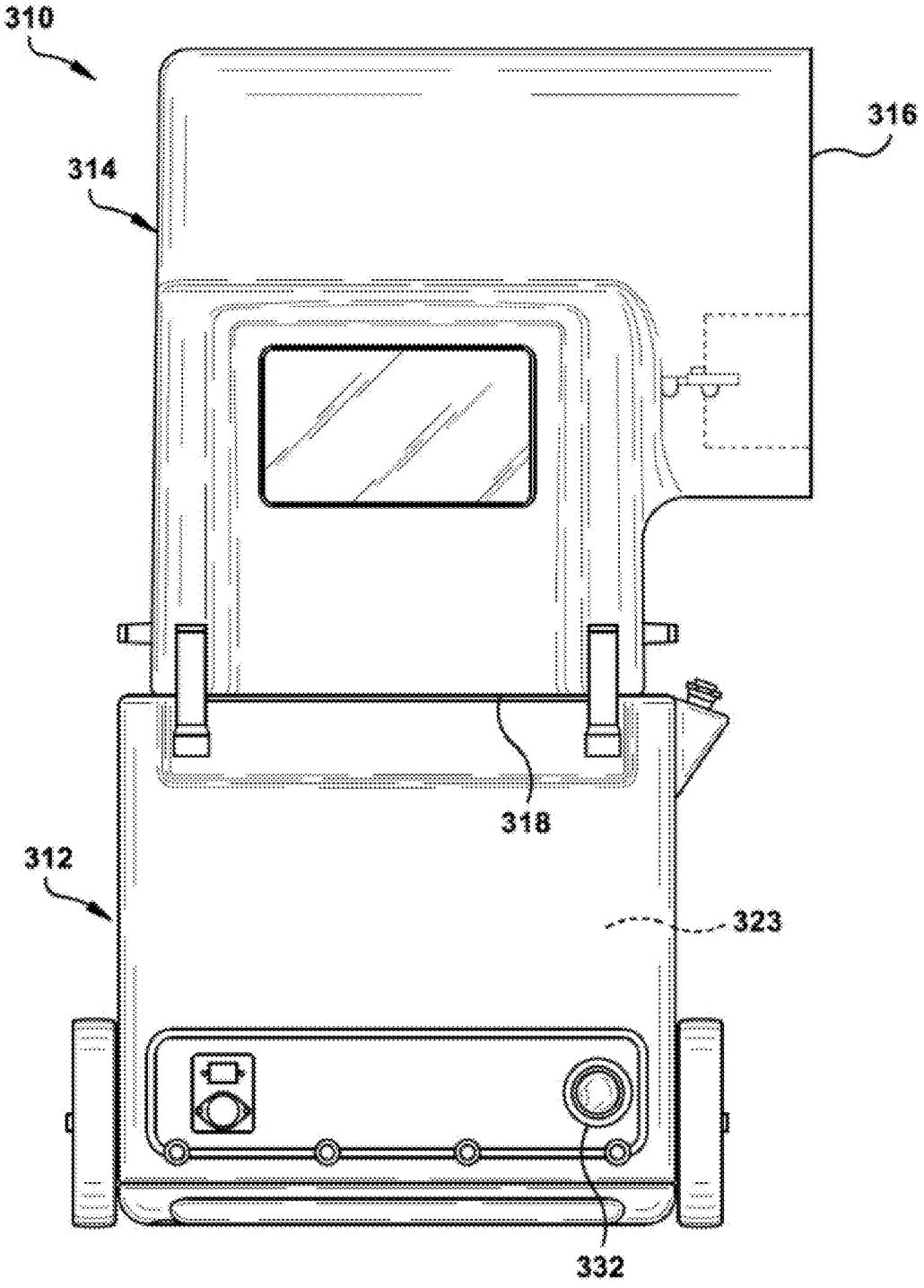
FIG. 2 is a rear view of a machine for installing unbonded loosefill insulation.
Figure 3:
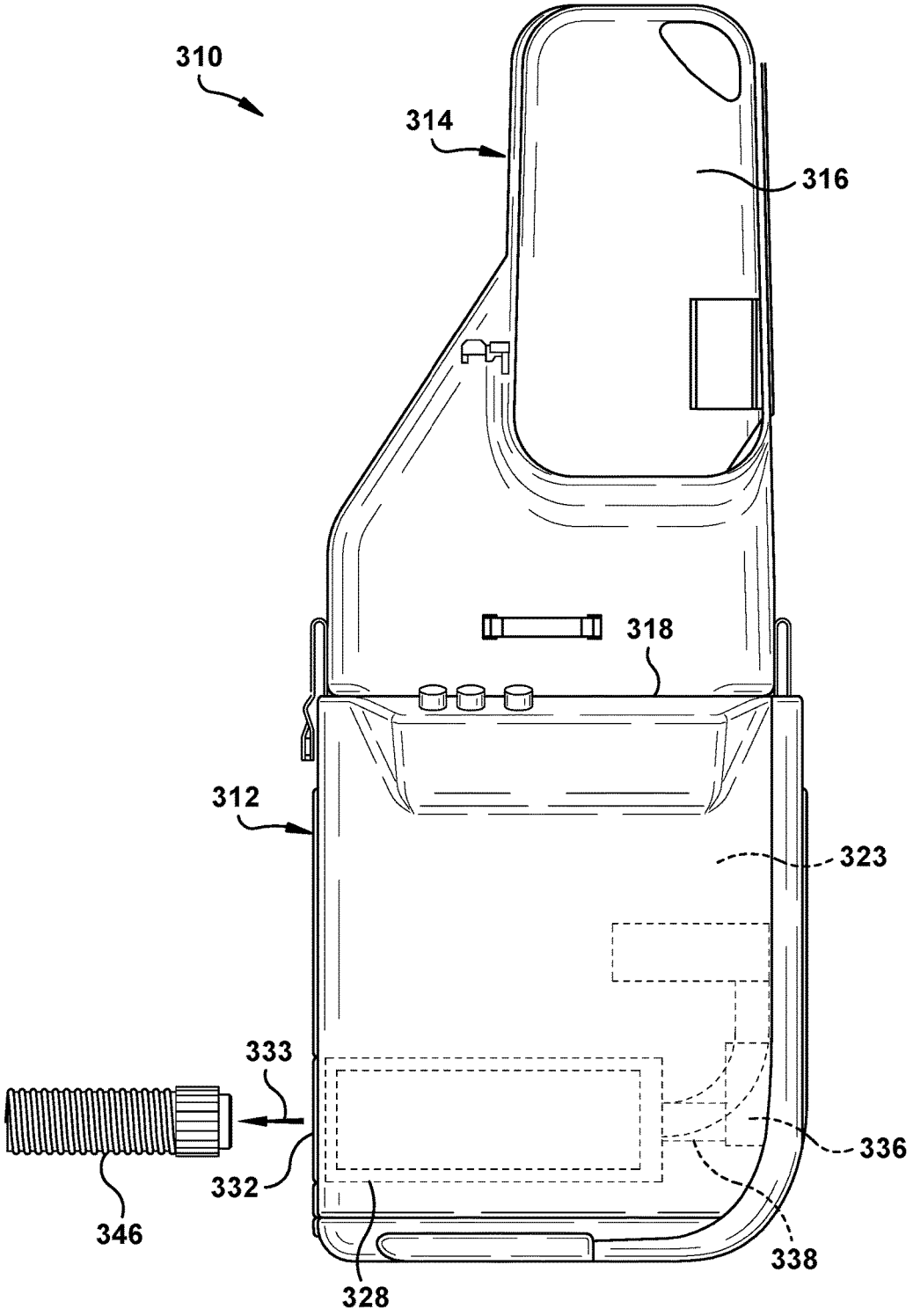
FIG. 3 is a side view of the machine for installing unbonded loosefill insulation illustrated by FIG. 2.

Referring to FIGS. 2 and 3, one example of a loosefill blowing machine, configured for distributing compressed unbonded loosefill insulation material is disclosed by U.S. Pat. No. 8,794,554 (herein "the '554 Patent"), which is incorporated herein by reference in its entirety. However, a wide variety of different loosefill blowing machines can be used. For example, other loosefill blowing machines may be available from Owens Corning, CertainTeed, Knauf, and Johns Manville.

Insulation blowing machines typically have a chute or hopper 314 for containing and feeding the loosefill material 222 after the package 220 is opened and the compressed loosefill material is allowed to expand. This loosefill blowing machine 310 of the '554 Patent includes a lower unit 312 and a chute 314. The chute 314 has an inlet end 316 and an outlet end 318. The chute 314 is configured to receive loosefill material and introduce the loosefill material to a shredding chamber 323.

The shredding chamber 323 is mounted at the outlet end 318 of the chute 314. The shredding chamber includes shredders and/or an agitator that are configured to shred and pick apart the loosefill material as the loosefill material is discharged from the outlet end 318 of the chute 314 into the lower unit 312. The resulting loosefill insulation material conditioned for distribution into an airstream. A discharge mechanism 328 (see FIG. 3) is positioned adjacent to distribute the conditioned loosefill material in an airstream. In this embodiment, the conditioned loosefill material is driven through the discharge mechanism 328 and through a machine outlet 332 by an airstream provided by a blower 336 mounted in the lower unit 312. The airstream is indicated by an arrow 333. In the illustrated embodiment, the blower 336 provides the airstream 333 to the discharge mechanism 328 through a duct 338, from the blower 336 to the discharge mechanism 328.

The finely conditioned loosefill material enters the discharge mechanism 328 for distribution into the airstream 333 caused by the blower 336. The airstream 333, with the finely conditioned loosefill material, exits the machine 310 at a machine outlet 332 and flows through a distribution hose 346, toward the location of the insulation.

A controller is configured to control the operation of the blower 336 such that the resulting flow rate of the airstream from the blower 336 to the discharge mechanism 328 is fixed at a desired flow rate level. As a result of the selected rotational speed of the blower 336, the flow rate of the airstream 333 through the loosefill blowing machine 310 is at the selected level.

Figure 4:
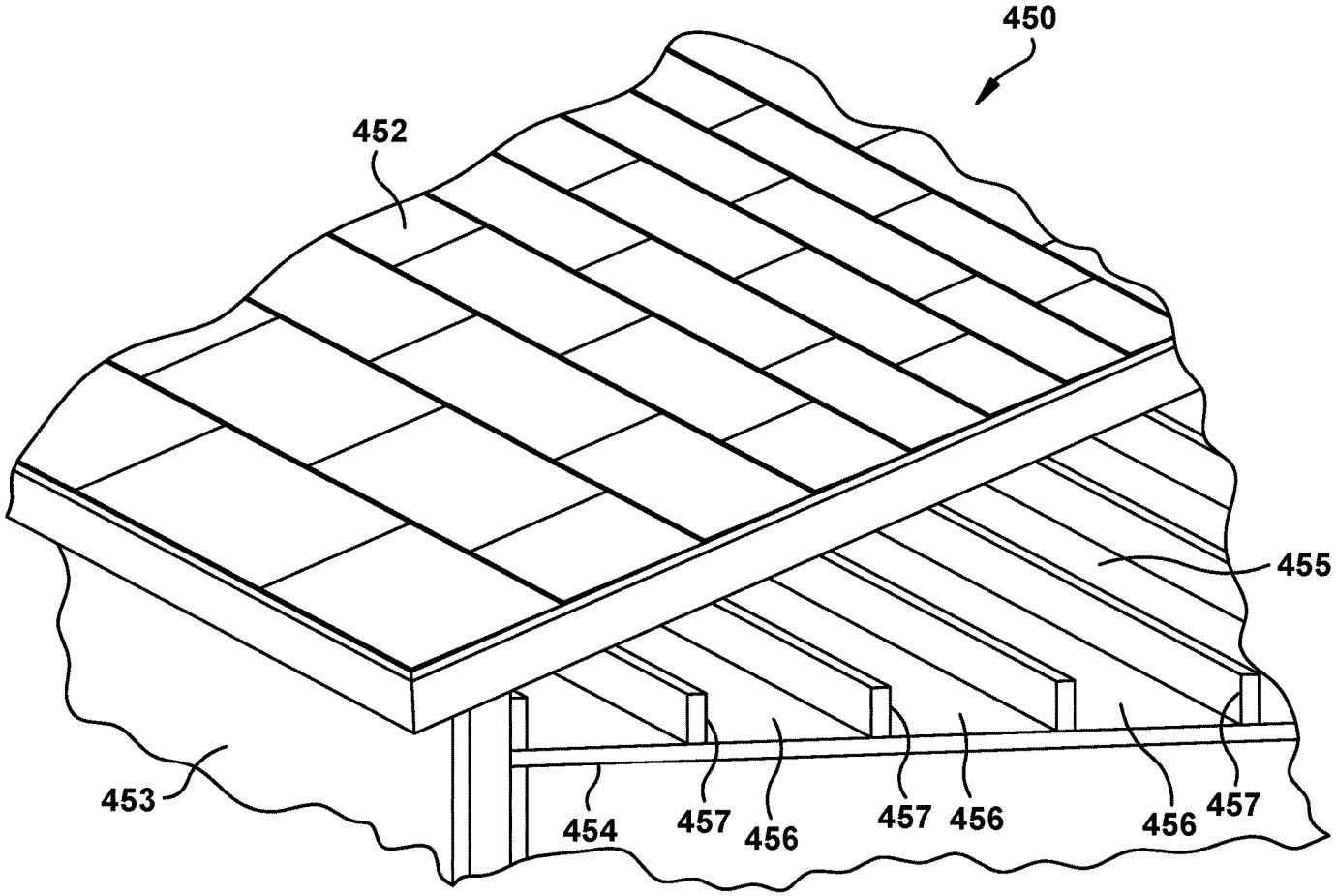
FIG. 4 is an illustration of a building having an attic.
Figure 5:
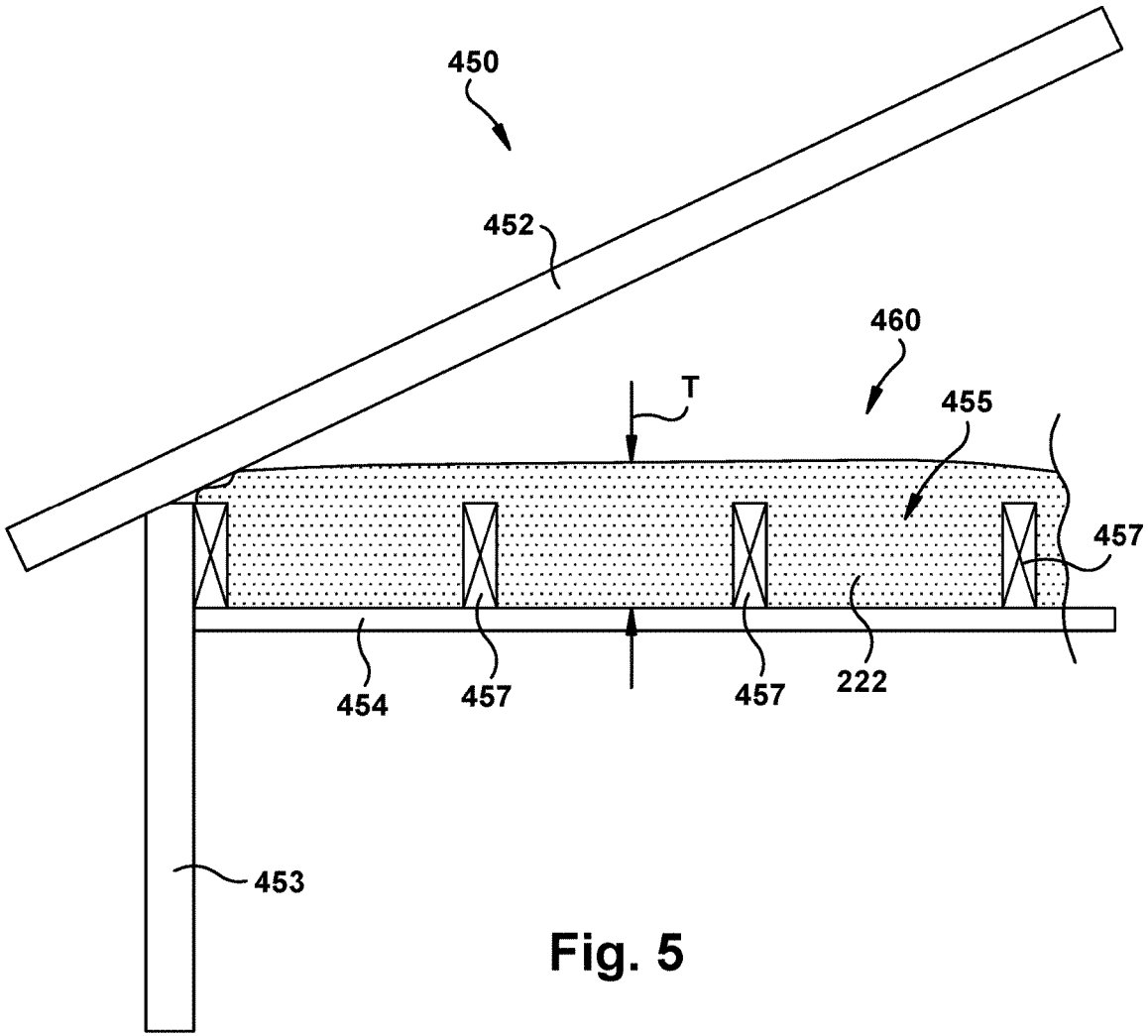
FIG. 5 is a side view of an unbonded loosefill insulation installation in the attic illustrated by FIG. 4.

Referring to FIG. 4, one example of a building having insulation cavities is illustrated at 450. The building 450 includes a roof deck 452, exterior walls 453 and an internal ceiling 454. An attic space 455 is formed internal to the building 450 by the roof deck 452, exterior walls 453 and the internal ceiling 454. A plurality of structural members 457 positioned in the attic space 45 and above the internal ceiling 454 defines a plurality of insulation cavities 456. The insulation cavities 456 can be filled with finely conditioned loosefill material 222 distributed by the loosefill blowing machine 310 through the distribution hose 346 to form a loosefill insulation installation 460 (See FIG. 5). The insulation cavities 456 can also be cavities between wall studs, floor joists, space between and/or under structural members that support the roof deck 452 or any other area of a building needing to be insulated.

In one exemplary embodiment, the operating parameters of the loosefill blowing machine 310 are tuned to the insulative characteristics of the associated unbonded loosefill insulation material such that the resulting blown loosefill insulation material provides improved insulative values. The operating parameters of the loosefill blowing machine can include the flow rate of the conditioned loosefill material 222 through the loosefill blowing machine 310 and the flow rate of the airstream 333 through the loosefill blowing machine 210.

The performance of loosefill insulation can be measured in a wide variety of different ways. In one exemplary embodiment, the performance of the loosefill insulation is measured in terms of an area of coverage, with a given thermal resistance value R, provided by a bag having a given weight and volume. For example, a loosefill insulation may be designated as L77. In this example, the "L" simply refers to loosefill. The "77" indicates that one bag (having a filled weight of 33 lb and having a volume of approximately 6,484 cubic inches) of compressed unbonded loosefill insulation material can provide 77 square feet of R30 thermal insulation when installed to 10.25 inches. In one exemplary embodiment, this "L" measure of performance is normalized for bags of compressed insulation having different weights and volumes. For example, the L value may be normalized based on the size of the bag, the weight of the bag, or a combination of the size and weight of the bag.

The insulation installation density and thickness may be adjusted to change the R value and the L performance measure. For example, insulation may be blown to 10.25" with a density of 0.502 pcf to provide an R30 thermal resistance. In this exemplary embodiment, one bag of insulation covers 77 square feet of attic at 10.25" thick, with an R30 thermal resistance, and a density of 0.502 pcf.

Increasing the L performance of a compressed bag of loosefill insulation means more coverage of the specified R value, for example R30, with a single bag of compressed insulation material. For example, an L80 is more insulation coverage in a single bag than a single bag of L77 insulation. L80 insulation provides at least 80 square feet of R30 insulation with a bag of insulation (having a filled weight of 33 lb and having a volume of approximately 6,484 cubic inches). This means fewer bags of compressed loosefill insulation need to be purchased, transported, stored, and installed. Depending on truck sizes, some contractors can add an additional job to their transit before having to return for another load. L80 is higher coverage than has been previously attainable with 33 lbs of loosefill insulation.

In one exemplary embodiment, the L80 loosefill insulation installation is thermally superior to L77 loosefill insulation by 4 k-points (1 k-point=0.001 Btu·in/hr·ft2·° F.). In one exemplary embodiment, the L80 insulation provides a loosefill insulation installation with an R30 thermal resistance at 80 square feet of coverage, a density of 0.472 pcf, at a thickness of 10.5 inches, from the standard bag having a weight of 33 lbs and a volume of approximately 6,484 cubic inches. These 4 k points of thermal improvement are unexpectedly achieved by reducing the mineral oil applied to the loosefill insulation material and/or increased air fluffing or air to wool ratio in the delivery hose. The insulation installation density and/or the manufactured manufactured density are reduced as compared to L77 insulation to improve coverage in one exemplary embodiment.

Another measure of the performance of loosefill insulation is by comparing the thermal conductivity of the loosefill insulation installation with the thermal conductivity of a hypothetical ideal batt having the same density. For example, an estimate of the thermal conductivity of a batt having truly random fiber orientation (i.e. no preferential fiber alignment), made from a typical fiberglass used for making fiberglass fibers for unbonded loosefill, having a fiber diameter of about 11.5 HT (hundred thousandths of an inch) can be provided by the following approximation:

$$k=0.176457+0.010579*\text{density}+0.035626/\text{density}.$$

for k in Btu-in/hr-sqft-F density in pcf (of the loosefill insulation installation that the ideal batt is being compared to)

The thermal conductivity k of the loosefill insulation installation can be compared to the calculated thermal conductivity k of the hypothetical ideal batt, as shown in the following equation.

$$\left(R(\text{insulation installation performance}) = \frac{k(\text{loosefill installation})}{k(\text{calculated ideal bat})}\right)$$

The calculated thermal conductivity of the ideal batt is the best thermal performance that a loosefill insulation installation could ever attain. As such, a ratio R of the thermal conductivity k of the loosefill insulation installation to the calculated k for the ideal batt is one measure of the performance of the loosefill insulation installation.

A perfect loosefill insulation installation would have an R (insulation installation performance)=1 (i.e., the loosefill insulation installation has the same thermal conductivity as the ideal batt. The closer the ratio R (insulation installation performance) is to 1, the better the performance of the loosefill insulation installation. In some exemplary embodiments, a ratio of the thermal conductivity of the loosefill insulation installation to an ideal batt having the same density as the average density of the loosefill insulation installation is between one and 1.5. In some exemplary embodiments, a ratio of the thermal conductivity of the loosefill insulation installation to an ideal batt having the same density and thickness as the loosefill insulation installation is between one and 1.4.

Applicants have unexpectedly found that reducing the amount of applied mineral oil by 25% to 75%, such as 35% to 60%, such as 40% to 55%, such as 50% or about 50% can improve thermal performance without negatively impacting measured and perceived dust. For example, in one exemplary embodiment the mineral oil is applied in amount by weight of the fiberglass fibers between 0.1% and 0.6%, such as between 0.2% and 0.5%, such as between 0.3% and 0.4%, such as between 0.5% and 0.6%. In one exemplary embodiment, the mineral oil may be applied in an amount by weight of fiberglass in any sub-range between 0.1% and 0.6%.

The installation machine 310 may be adjusted to install the loosefill insulation at a higher air flow rate, with more loosefill insulation material delivered, and through larger diameter hoses. For example, the air flow rate of the installation machine may be greater than 4500 feet per minute (fpm), such as between 4500 and 7500 fpm, such as between 5000 and 6000 fpm. For example, the loosefill insulation delivery rate may be greater than 17 pounds per minute, such as between 17 pounds per minute and 35 pounds per minute, such as about 20-25 pounds per minute. In one exemplary embodiment, the diameter of the hose 346 is between 3½ inches and 4 inches. In one exemplary embodiment, one, two or more sections of hoses having a diameter of 4 inches is connected to the blowing machine, and one or more sections of hose having a diameter of 3½ inches is connected to the 4 inch diameter section, and the loosefill insulation material 222 is dispensed from the end of the 3½ inch diameter section to the site of the insulation installation. The larger hose diameters of 3½-4 inches in diameter decreases the density of the fiberglass insulation installation and also allow for faster material feed rates mentioned above.

In one exemplary embodiment, the insulation installation has a reduced installed density, that is less than 0.502 pounds per cubic feet (pcf), such as less than or equal to 0.485 pcf, less than or equal to 0.472 pcf, such as about 0.472 pcf.

Table 1 is provided below, are derived from results of tests on L80 insulation installations having different thicknesses and corresponding thermal resistances R. In the example of Table 1 the unbonded loosefill insulation material is made from fiberglass fibers having a typical glass fiber composition, such as $SiO_2$, $Al_2O_3$, CaO, MgO, $B_2O_3$, $Na_2O$, $K_2O$, and $Fe_2O_3$. The glass fibers have a typical fiber diameter, such as 11.5 HT (hundred thousandths of an inch). The glass fibers a coated with a polysiloxane in an amount of 0.075% by weight of the glass fibers. A mineral oil is applied to the loosefill material in an amount of between 0.1% and 0.6% by weight of the glass fibers. In one example, the mineral oil is applied to the loosefill material in an amount of 0.375% and the thermal performance identified by Table 1 is achieved. The loosefill insulation material is compressed into a bag to form a 33 lb pound bag of loosefill insulation having a volume of approximately 6,484 cubic inches. The bag of loosefill insulation material is opened and blown to form the loosefill insulation installations having the thicknesses listed on the table with a commercial blowing machine. The commercial loosefill blowing machine blows the loosefill insulation material through a first hose section having the larger diameters described above. The commercial loosefill blowing machine provides an air pressure between 2.0 and 3.5 psi through the hose and delivers the loosefill material at a rate of about 20-30 lb/min, such as about 20 lb/min.

Applicant has found that with the reduced mineral oil the Thermal conductivity (k)=0.1920+0.0744/blown density. Table 1 was constructed using the this equation showing the unexpected improved thermal conductivity, but rounded to the nearest ¼ Minimum Thickness, a common industry practice. For example, an-R30 installation at 0.472 pcf blown density has a thermal conductivity of 0.350. An "Ideal Batt" of R30 performance would have a corresponding thermal conductivity of 0.257, which corresponds to a ratio of 1.362 and an Rsf/lb of 72.7". Table 1 illustrates that the thermal resistance (R) of the insulation installation 460 can be varied by varying the thickness or average thickness T of the installation. As one specific example of the improved insulative characteristic, a 1000 square foot insulation installation, having a thermal resistance (R) of 30, and having an average thickness of 10.5 inches can be achieved with as few as 12.5 bags of compressed insulation material.

TABLE 1

L80 Rounded to the nearest ¼ inch

| R-Value | Minimum Thickness | Minimum weight per sf | Bags/ 1000 sf | Maximum Net Coverage |
|---|---|---|---|---|
| 60 | 19.75 | 0.898 | 27.2 | 36.8 |
| 49 | 16.50 | 0.714 | 21.6 | 46.2 |
| 44 | 15.00 | 0.634 | 19.2 | 52.0 |
| 38 | 13.00 | 0.532 | 16.1 | 62.0 |
| 30 | 10.50 | 0.413 | 12.5 | 80.0 |
| 26 | 9.25 | 0.356 | 10.8 | 92.8 |
| 22 | 7.75 | 0.290 | 8.8 | 113.7 |
| 19 | 6.75 | 0.248 | 7.5 | 132.9 |
| 13 | 4.75 | 0.168 | 5.1 | 195.9 |

In Table 1, the R-Value is the thermal resistance of the insulation installation. Average thickness is the average thickness in inches of the insulation installation. Average weight per sf is the average weight in pounds per square foot of the insulation installation. Bags/1000 sf is the number of bags needed to provide the given R value with 1000 square foot of coverage. Net coverage is the number of square feet covered at the given R value with a single compressed bag of loosefill insulation material.

In this application, D is the density of the insulation in the loosefill insulation installation in pounds per cubic foot. k is the average thermal conductivity across the thickness of the insulation installation. Ideal batt is a mathematical representation of a thermal conductivity of a hypothetical ideal batt (random fiber orientation) with 11.5 HT (hundred thousandths of an inch) fiber diameter (i.e. same diameter as the unbonded loosefill fiberglass fibers) and the same glass composition as the unbonded loosefill glass over a range of density values. As mentioned above, the mathematical representation for the ideal batt is:

$$k=0.176457+0.010579*\text{density}+0.035626/\text{density}$$

for k in Btu-in/hr-sqft-F and density in pcf.

Ratio is the ratio of the measured average thermal conductivity to the calculated ideal batt thermal conductivity.

Rsf/lb is (R-Value)*(Net Coverage)/(Compressed insulation bag weight).

Figure 6:
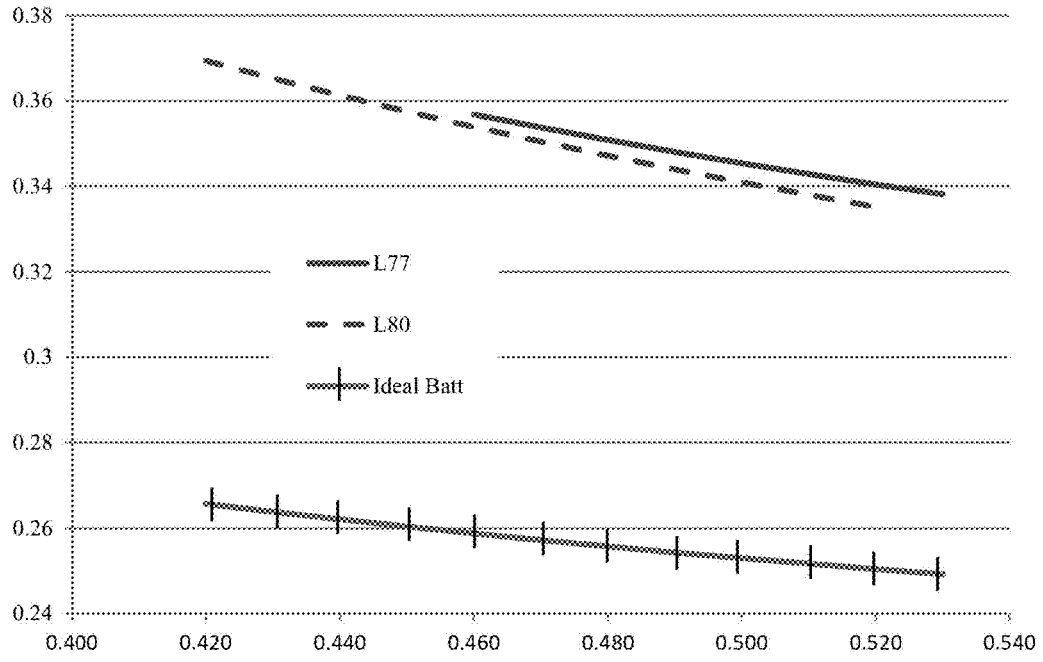
FIG. 6 is a graph that plots the thermal conductivity of the L80 example of Table 1, an L77 insulation installation, and a hypothetical ideal batt.

In one exemplary embodiment, values between the values provided in Table 1 can be plotted on a graph to interpolate values between data points of the tables. For example, the dashed line in the graph 600 of FIG. 6 plots thermal conductivity k (y-axis) of the L80 insulation of the example of Table 1 versus density (x-axis). The solid line above the dashed line is a plot for an L77 insulation installation. This shows that the thermal conductivity k of the L80 example is lower (i.e. thermally better) than the L77 insulation. The solid hashed line below the dashed line in Graph 1 plots thermal conductivity k (y-axis) of the hypothetical ideal batt versus density (x-axis). The ideal batt is the limit on the thermal performance of unbonded loosefill insulation. A closer plot for the unbonded loosefill insulation installations to the plot for the ideal bat represents improved performance.

As a comparative example, with 0.75% mineral oil the Thermal conductivity (k)=0.1959+0.0744/blown density. Table 2 was constructed using this equation, also rounded to the nearest ¼" Minimum Thickness. For example, an installation at the same 0.472 pcf blown density yields the higher thermal conductivity of 0.354 (compared to 0.350 of the example with 0.375% mineral oil). The comparison of Table 1 with Table 2 illustrates the unexpected result of improved thermal performance of loosefill insulation by reducing the amount of applied mineral oil. In the example of Table 1, the loosefill insulation includes 0.375% mineral oil by glass weight. In the example Table 2, the loosefill insulation includes 0.750% mineral oil by glass weight. Tables 1 and 2 illustrate the loosefill insulation with less mineral oil (0.375%) thermally outperforms the loosefill insulation material with more mineral oil (0.750%) in an attic application.

TABLE 2

Thermal Performance of ULF with 0.75% by weight mineral oil

| R-Value | Minimum Thickness | Minimum weight per sf | Bags/ 1000 sf | Maximum Net Coverage |
|---|---|---|---|---|
| 60 | 20.00 | 0.914 | 27.7 | 36.1 |
| 49 | 16.50 | 0.715 | 21.7 | 46.1 |
| 44 | 15.00 | 0.635 | 19.2 | 52.0 |
| 38 | 13.25 | 0.546 | 16.5 | 60.5 |
| 30 | 10.50 | 0.413 | 12.5 | 79.9 |
| 26 | 9.25 | 0.356 | 10.8 | 92.6 |
| 22 | 8.00 | 0.301 | 9.1 | 109.5 |
| 19 | 7.00 | 0.259 | 7.9 | 127.4 |
| 13 | 4.75 | 0.169 | 5.1 | 195.6 |

Mineral oil is commonly used to address problems that decrease the thermal performance of the unbonded loosefill insulation. One such problem addressed by the application of mineral oil is known as particle attriction. Particle attriction is encountered in the manufacturing and installation of unbonded blowing or loosefill insulation. Particle attrition occurs in the pneumatic transport phases. A particular problem is the rolling and bundling of the otherwise discrete fiber entanglements into high density masses. This leads to loss of material efficiency in both thermal conductivity and the ability to effectively fill the desired installation volume. The inability to effectively fill the installation volume comes from the material property called material density. High fiber attrition is known to increase material density by reducing particle size resulting in undesired increased particle nesting.

Another problem addressed by the application of mineral oil is dust. Dust is created during pneumatic transport phases of manufacturing and installation of unbonded loosefill insulation. Dust is also a product of material attrition. High dust is another cause of material inefficiency through increased material density.

The application of mineral oil within the manufacturing process is a common preventative and remedy for the above mentioned problems. Mineral oil use has been attributed to providing adequate fiber-coating and air-entrainment lubricity to the blowing insulation such that particle attrition, static charge, and dust are reasonable controlled. Mineral oil is chosen due to its relative cost and refinement properties such as relatively low coating viscosity.

In many of the exemplary embodiments disclosed in the present application, mineral oil levels are significantly reduced from that commonly applied in the manufacturing process, yet have caused a significant improvement in the unbonded loosefill insulation material thermal efficiency (See for example Tables 1 and 2). The improvement in material efficiency occurring from the reduction of applied mineral oil is a surprising result. In light of the previously mentioned interactions of glass fibers and mineral oil in both the manufacturing and installation processes, thermal efficiency would be expected to decrease, not increase. For example, it would be expected that the problem of fiber attrition would get worse when the amount of mineral oil is reduced, resulting in reduced thermal efficiency of the unbonded loosefill insulation. Yet, Tables 1 and 2 illustrate an improvement in thermal performance of the unbonded loosefill insulation with the reduced mineral oil.

While the discussion above has been focused on reducing the amount of mineral oil that is applied, the size of the distribution hose, the air velocity, and the flow rate of the loosefill material, it should be appreciated that in other embodiments, not all of these parameters need to be adjusted and other parameters of the loosefill insulation material and/or the blowing machine can be changed to provide improved insulative characteristics of the resulting blown insulation installation.

The principle and methods of a loosefill insulation installation have been described in the above exemplary embodiments. However, it should be noted that the loosefill insulation installation may be practiced otherwise than as specifically illustrated and described without departing from its scope. For example, any combination or sub combination of the features of the loosefill insulation material, the loosefill insulation installation, and/or the methods for installing loosefill insulation can be combined and are contemplated by the present application.

The invention claimed is:

1. A loosefill insulation installation comprising:

a loosefill insulation material made from fiberglass fibers;

wherein the loosefill insulation material has an average installed thickness;

wherein the average density of 10.5 inches of the installed loosefill insulation material is less than or equal to 0.485 pounds per cubic foot;

wherein a ratio of the thermal conductivity of the loosefill insulation installation to an ideal batt having the same density as the average density of the loosefill insulation installation is between one and 1.5; and wherein the fiberglass fibers are coated with a mineral oil in an amount that is between 0.1% and 0.6% of the weight of the fiberglass fibers.

2. The loosefill insulation installation of claim 1, wherein the fiberglass fibers comprise a combination of two or more of $SiO_2$, $Al_2O_3$, CaO, MgO, $B_2O_3$, $Na_2O$, $K_2O$, and $Fe_2O_3$.

3. The loosefill insulation installation of claim 1, wherein the mineral oil is between 0.2% and 0.5% of the weight of the fiberglass fibers.

4. The loosefill insulation installation of claim 3, wherein the mineral oil is a blend of light and heavy paraffinic oils.

5. The loosefill insulation installation of claim 3, wherein the mineral oil has a viscosity of less than or equal to 20 cST at 40 degrees centigrade, and less than or equal to 50 cST at 20 degrees centigrade.

6. The loosefill insulation installation of claim 3, wherein the mineral oil has a pour point in the range of −10 degrees Fahrenheit to 0 degrees Fahrenheit.

7. The loosefill insulation installation of claim 3, wherein the mineral oil has a flash point that is below or equal to 365 degrees Fahrenheit.

8. The loosefill insulation installation of claim 1, wherein a ratio of the thermal conductivity of the loosefill insulation installation to an ideal batt having the same density and thickness as the loosefill insulation installation is between one and 1.4.

* * * * *